US006050459A

United States Patent [19]

Johnson et al.

[11] Patent Number: 6,050,459

[45] Date of Patent: Apr. 18, 2000

[54] RIGID DIP TUBE CONNECTOR FOR A LIQUID SPRAY DISPENSER

[75] Inventors: Joseph E. Johnson, Noank, Conn.; Clifford W. Skillin, Blackstone, Mass.

[73] Assignee: Polytop Corporation, Slatersville, R.I.

[21] Appl. No.: 09/372,815

[22] Filed: Aug. 12, 1999

[51] Int. Cl.[7] ..... B67D 5/40

[52] U.S. Cl. ..... 222/382; 222/383.3; 222/464.1; 222/530; 222/556

[58] Field of Search ..... 222/382, 383.1, 222/383.3, 464.1, 530, 529, 556

[56] References Cited

U.S. PATENT DOCUMENTS

| | | | |
|---|---|---|---|
| 3,333,741 | 8/1967 | Radcliffe | 222/382 |
| 5,553,750 | 9/1996 | Foster | 222/382 X |
| 5,938,087 | 8/1999 | Randall | 222/556 X |
| 5,988,456 | 11/1999 | Laible | 222/464.1 |

*Primary Examiner*—Kevin Shaver
*Assistant Examiner*—Thach Bui
*Attorney, Agent, or Firm*—Hoffman, Wasson & Gitler

[57] ABSTRACT

A rigid dip tube connector for a trigger spray bottle having a threaded opening. A cap body is screwed onto the opening and has a hinged cap attached thereto. The cap body has an annulus and an opening in the center for supporting a rigid dip tube. A plastic connector is provided and has a cylindrical bore extending from its bottom which fits into the opening in the cap body. The plastic connector is cylindrical and has an annulus in its upper portion for receiving a flexible tube for connection to a sprayer. The plastic connector fits into the annulus of the cap body so that the rigid dip tube and flexible tube align with one another. In a second embodiment, the annulus of the cap body is open and the rigid dip tube connects directly to the plastic connector or plunger. As a result, the plastic connector by itself connects and aligns the rigid dip tube and the flexible tube. The plastic connector snap fits into the opening of the cap body.

14 Claims, 6 Drawing Sheets

RIGID DIP TUBE CONNECTOR FOR A LIQUID SPRAY DISPENSER

BACKGROUND OF THE INVENTION

1. Field of the Invention

The present invention relates to a spray dispenser having a rigid dip tube connector. More particularly, the present invention relates to a fluid container having a spray nozzle that is connected by a flexible hose. The flexible hose connects to the fluid container through a rigid dip tube connector.

2. Description of the Prior Art

Liquid containers which utilize a spray head attached by a flexible tube are well known. For example, U.S. Pat. No. 5,651,908 to Mansfield discloses a fluid container having a storage location for a discharge end of an attached flexible hose. Rigid dip tubes are well known for use in liquid containers to help draw as much of the fluid as possible from the container. The rigid dip tube extend to close to the bottom of the container.

While containers such as Mansfield employ a flexible hose, they do not draw all of the fluid from the container. Furthermore, the Mansfield device can not be used with standard containers, but rather require the specific container disclosed in the patent.

SUMMARY OF THE INVENTION

These and other deficiencies of the prior art are addressed by the present invention which is directed to a rigid dip tube connector for a trigger spray bottle having a threaded opening. A cap body is screwed onto the opening and has a hinged cap attached thereto. The cap body has an annulus and an opening in the center for supporting a rigid dip tube. A plastic connector is provided and has a cylindrical bore extending from its bottom which fits into the opening in the cap body. The plastic connector is cylindrical and has an annulus in its upper portion for receiving a flexible tube for connection to a sprayer.

When the plastic connector is fitted into the annulus of the cap body the rigid dip tube and flexible tube align with one another. In a second embodiment, the annulus of the cap body is completely open and the rigid dip tube connects directly to the plastic connector or plunger. As a result, the plastic connector by itself would connect and align the rigid dip tube and the flexible tube. The plastic connector would snap fit into the opening of the cap body. If a liner or gasket is used to reduce the potential for leakage between the cap and the bottle, the rigid dip tube would serve as a lance to pierce through this liner during initial assembly of the tube connector sprayer sub assembly to the cap/cap body.

An object of the present invention is to provide a device for aligning a rigid dip tube with a flexible tube connected to a spray head.

Another object of the present invention is to provide a device for aligning a rigid dip tube with a flexible tube connected to a spray head which can be used with standard containers.

Yet another object of the present invention is to provide a device which supports a spray head on a standard container.

Still another object of the present invention is to provide a device for aligning a rigid dip tube with a flexible tube connected to a spray head which has a relatively simple construction and is relatively inexpensive to produce.

BRIEF DESCRIPTION OF THE DRAWINGS

These and other attributes of the present invention will be described with respect to the following drawings in which.

DETAILED DESCRIPTION OF THE INVENTION

Figure 1:
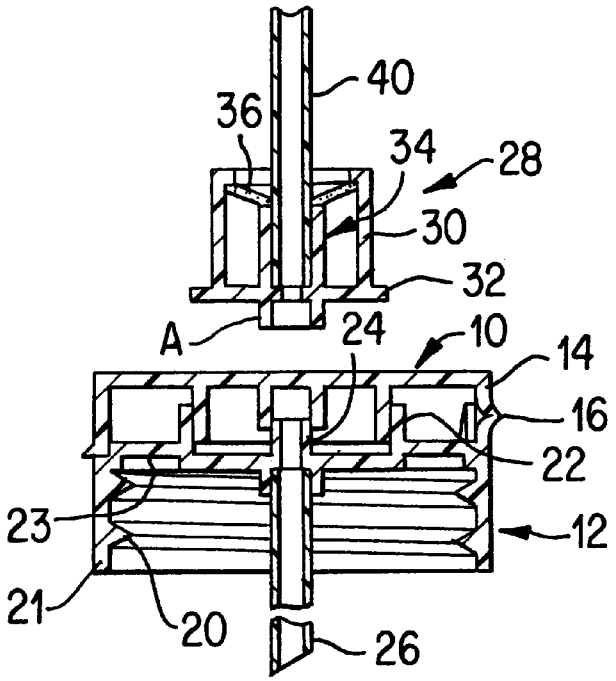
FIG. 1 is a cross-sectional view of a cap body, plastic connector, flexible tube and rigid dip tube according to a first embodiment of the present invention.

Referring to FIGS. 1–4, a first embodiment of the present invention is illustrated. The assembly includes a cap body 10 having a lower body portion 12 and a cap 14. The cap 14 is connected to the body portion 12 by hinge 16. The body 10 has internal threads 20 on the inside of cylindrical side wall 21, which mate with threads on a liquid container, discussed below. The cap body 10 has an annulus 23 projecting inward from the upper edge of the cylindrical side wall 21, and a first outer cylindrical wall 22 which is disposed parallel to and inward of the outer cylindrical portion of the cap body 10. A second inner cylindrical wall 24 parallel to the first cylindrical wall is provided. Both the first outer cylindrical wall 22 and the second inner cylindrical wall 24 project upward from the annulus 23.

The cap body 10 is attached to the threaded opening of a liquid container shown in FIG. 9*a* and discussed below. The cap 14 is closed about the hinge 16 to fit onto the body portion 12 and thereby close the container. The inner cylindrical wall 24 is sized to accept a rigid dip tube 26 in a friction fit engagement. The rigid dip tube 26 extends into the container to facilitate access to the liquid contents of the container.

A plastic connector or plunger 28 is provided separately from the cap body 10. The plastic connector 28 has a cylindrical body 30 which extends upwards perpendicularly from a base 32. The base 32 is circular and has an outer diameter approximately equal to the inner diameter of the first outer cylindrical wall 22. The plastic connector 28 also has a cylindrical projection A extending downward from the base 32 on a side opposite to the cylindrical body 30. The cylindrical projection A has an inner diameter approximately equal to the outer diameter of the second inner cylindrical wall 24. As a result of the foregoing configuration, the plastic connector 28 attaches to the body portion 12 of the cap body 10. When the plastic connector 28 is attached to the body portion 12, the cylindrical projection A fits around the second inner cylindrical wall 24 and the base 32 fits within the first outer cylindrical wall 22.

Figure 2:
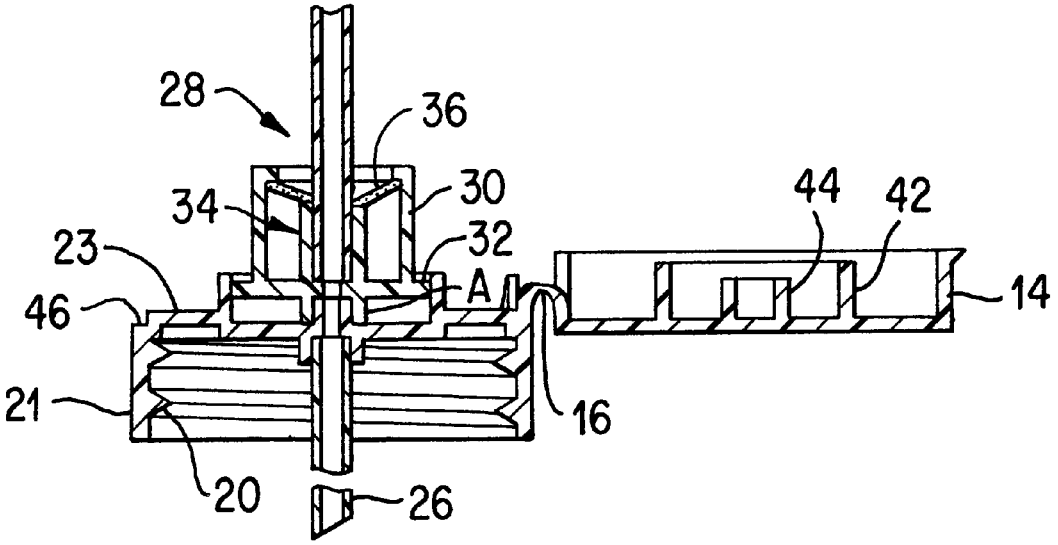
FIG. 2 is a cross-sectional view of a cap body, plastic connector, flexible tube and rigid dip tube shown in FIG. 1 with the plastic connector and cap body connected.
Figure 3:
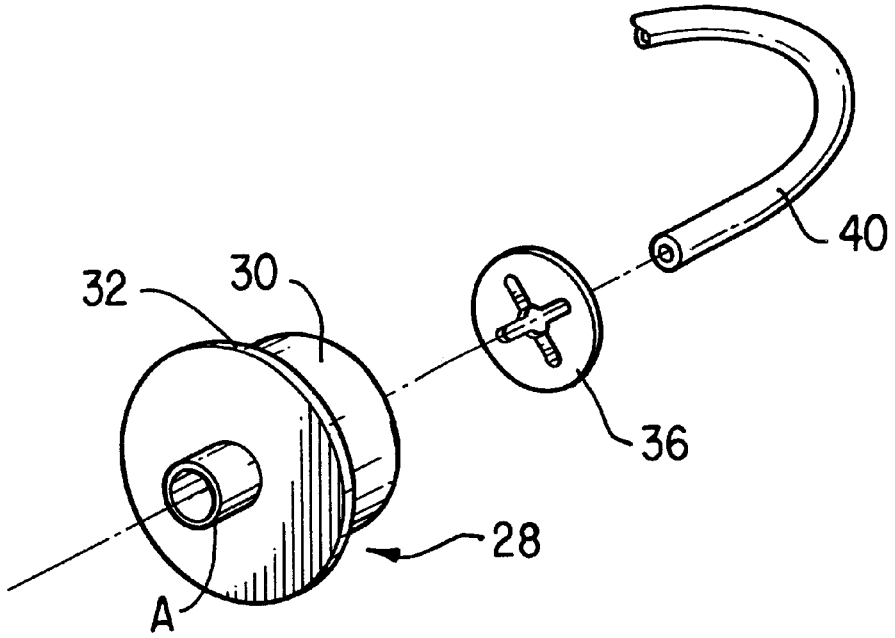
FIG. 3 is a perspective view of the plastic connector and flexible tube.

The plastic connector 28 further has an inner cylindrical wall 34 disposed inside the cylindrical body 30, and has a frusto-conical projection 35, extending outwards and upwards from its upper end. A conical ring 36, shown in FIGS. 1–3, is disposed above frusto-conical projection of the cylindrical wall 34. The cylindrical wall 34 and the conical ring 36 are sized to accept the base of a flexible tube 40 which has its opposite end attached a sprayer 50 shown in FIGS. 9*a*–9*c*.

Figure 4:
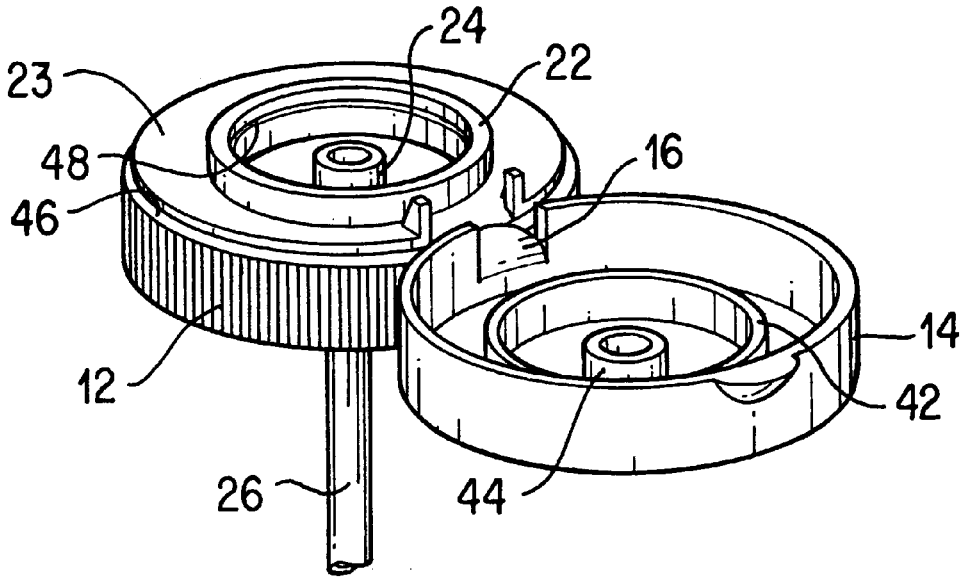
FIG. 4 is a perspective view of the cap body of the first embodiment, with the cap body in the open position and the rigid dip tube extending downward.

Referring to FIGS. 1, 2 and 4, the cap 14 may have inwardly projecting walls 42 and 44. Wall 42 fits within the first outer cylindrical wall 22, and wall 44 fits around the second inner cylindrical wall 24, when the cap 14 is closed on the body portion 12. The interconnection of the walls 42 and 44 with cylindrical wall 22 and 24 may be reversed so that the wall 22 fits within the wall 42, for example.

The body portion 12 may have a circular step 46, shown in FIGS. 2 and 4, with a diameter equal to the inner diameter of the cap 14, thereby assisting in the closure of the cap. Similarly, the first outer cylindrical wall 22 may have an inner cylindrical step 48 to help support and locate the base 32.

As a result of the foregoing configuration, when the cap body 10 is open, the plastic connector 28 fits into the first outer cylindrical wall 22. The plastic connector 28 and the cap body 10 combine to align the flexible tube and the rigid dip tube 26.

Figure 5:
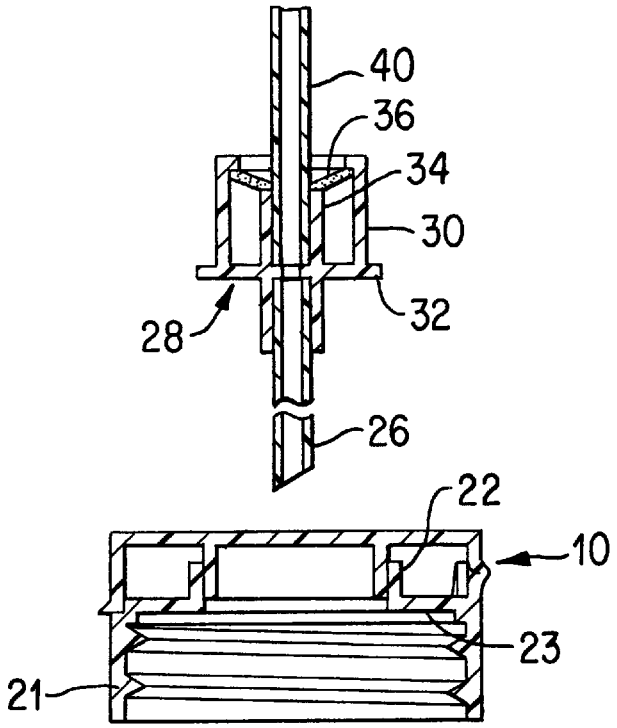
FIG. 5 is a cross-sectional view of a cap body, plastic connector, flexible tube and rigid dip tube according to a second embodiment of the present invention.
Figure 6:
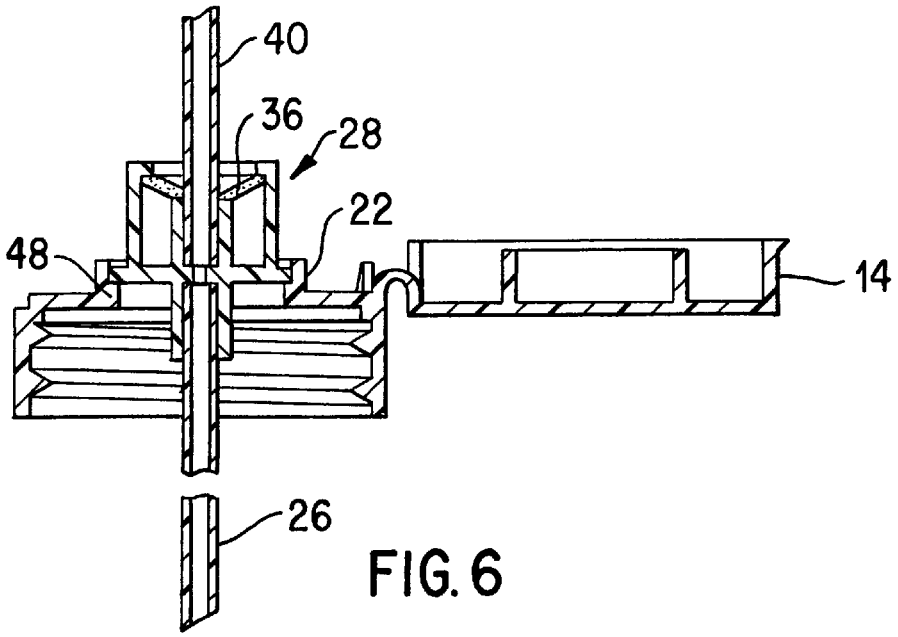
FIG. 6 is a cross-sectional view of a cap body, plastic connector, flexible tube and rigid dip tube shown in FIG. 5 with the plastic connector and cap body connected and the gasket or liner (optional) between the cap body and the container pierced by the rigid dip tube.

A second embodiment is illustrated in FIGS. 5–8, and is similar to the first embodiment. The plastic connector 28 is identical to the plastic connector of the first embodiment, except that the cylindrical projection A is sized to support the rigid dip tube 26. As a result, the plastic connector 28 aligns the flexible tube 40 and the rigid dip tube 26 by itself. The cap body 10 does not directly work in aligning the dip tube 26 and flexible tube 40, but rather supports the plastic connector 28. The inner cylindrical wall 34 and the cylindrical projection A are integrally formed with the base 32, as shown in FIGS. 5 and 6.

The cap body 10 still has an annulus 23 projecting inward from the upper edge of the cylindrical side wall 21, and a first outer cylindrical wall 22 which is disposed parallel to and inward of the outer cylindrical portion of the cap body 10. The first outer cylindrical wall 22 projects upward from the annulus 23 in the same manner as the first embodiment. The area inside of the first outer cylindrical wall 22 is open forming a circular opening 60. The base 32 of the plastic connector 28 fits into inner cylindrical wall 22 and is supported by an inner cylindrical step 48 formed integrally with the first outer cylindrical wall 22, as shown in FIG. 6, so that the connector 28 can not be pushed through the opening 60.

Figure 8A:
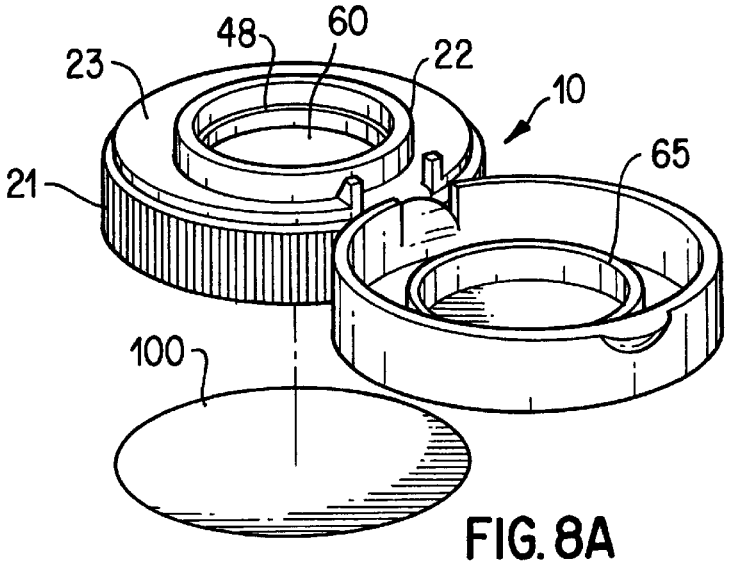
FIGS. 8*a* and 8*b* are perspective views of the cap body of the second embodiment, with the cap body in the open position.

Referring to FIG. 8*a* the cap 14 has an inwardly projecting wall 65. The wall 65 fits within the first outer cylindrical wall 22. The plastic connector 28 by itself connects and aligns the rigid dip tube 26 and the flexible tube 40, and the plastic connector 28 snap fits into the opening formed inside the first outer cylindrical wall 22 of the cap body 12.

Figure 8B:
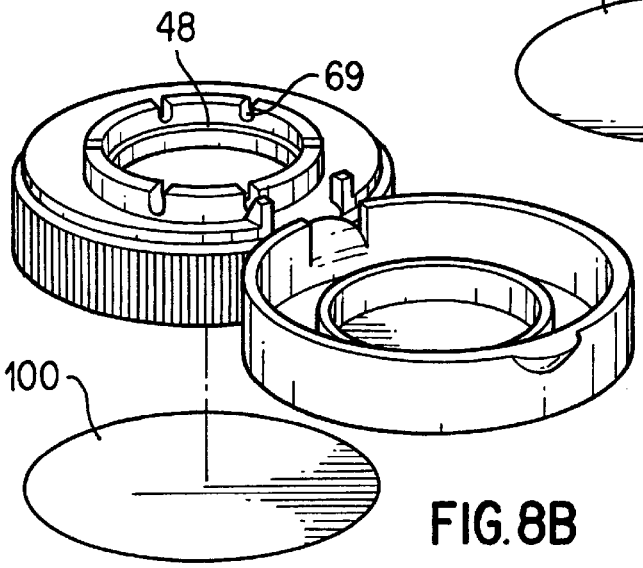

Alternatively, the cap 14 may have vertical slots 69 formed in the first cylindrical outer wall 22, as shown in FIG. 8*b*. As a result, the first cylindrical outer wall 22 may provide a better interference fit with the base 32 of the connector 28, to provide better retention of the connector 28.

Figure 9A:
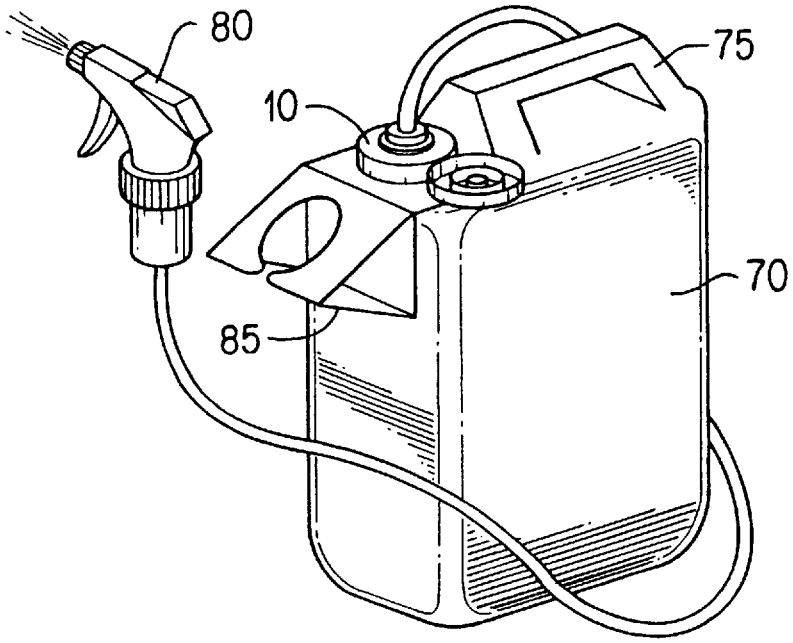
FIGS. 9*a*–9*c* are perspective views of a spray bottle assembly incorporating the present invention.
Figure 9C:
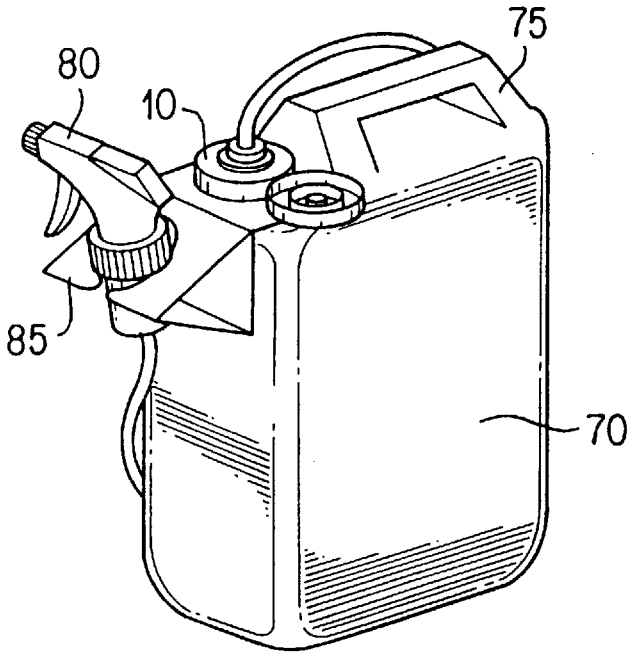
Figure 9B:
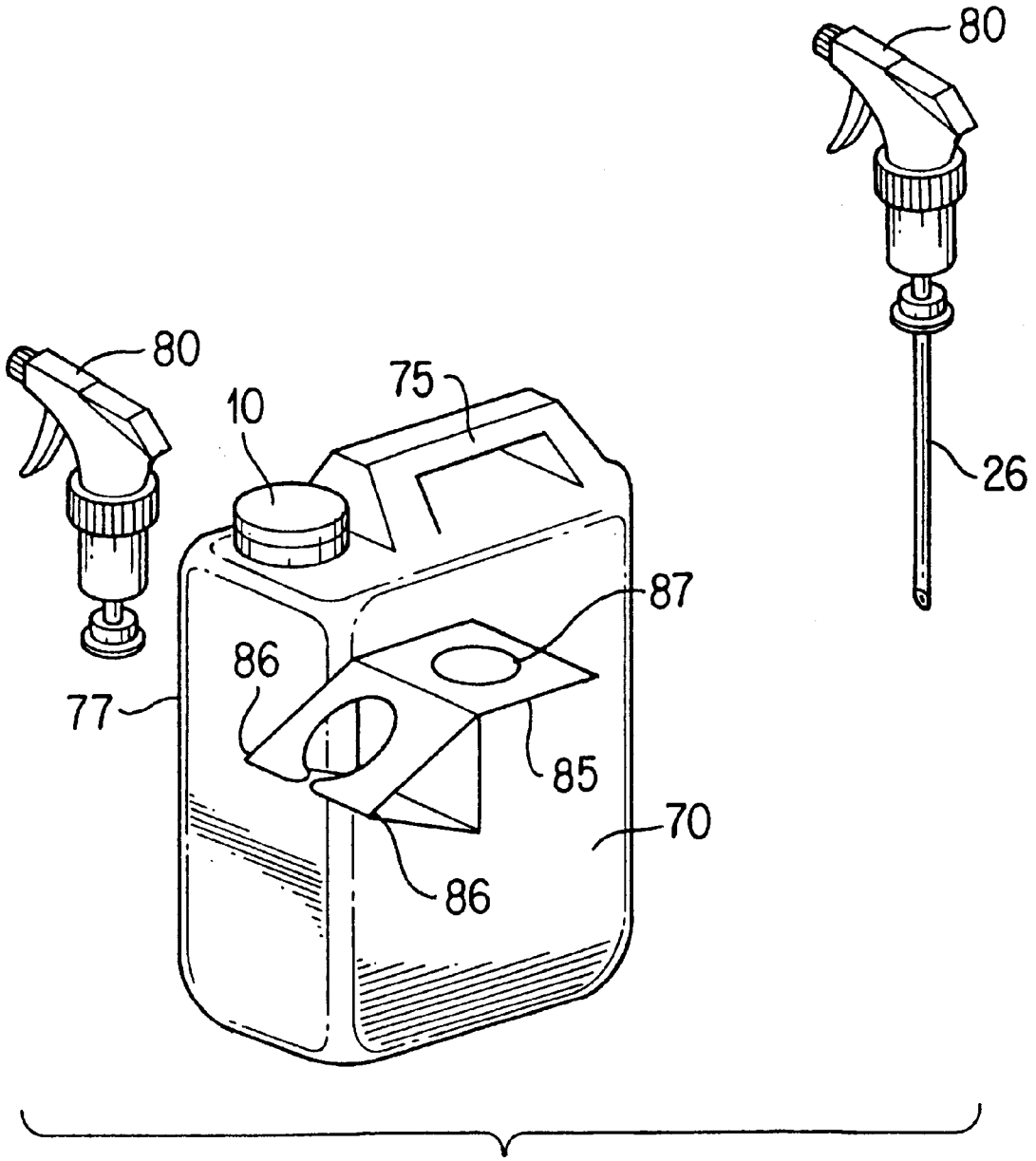

The foregoing first and second embodiments are intended to be utilized with a liquid container 70 shown in FIGS. 9*a*–9*c*. The container 70 is a standard container for holding liquids. The container 70 is usually made from plastic and has an integral handle 75. A threaded opening 77 is provided on the top of the bottle neck of the container, and the cap body 10 is threadably attached thereto.

The rigid dip tube 26 may be used to pierce the liner gasket 100. The liner gasket 100 will then lie on top of the cylindrical threaded opening 77 of the bottle neck. The liner gasket 100 is inserted inside the side wall 21 of the body portion 12. When the cap body 10 is connected to the threaded opening 77 of the bottle neck , the liner gasket 100 is induction heated to the top surface of the threaded opening 77 of the bottle neck.

The flexible tube 40, of the present invention connects to a trigger sprayer 80. A person carries the container 70, by the handle 75, in one hand, while holding the trigger sprayer 80 in the other hand. When not in use, the trigger sprayer 80 may be held in a trigger sprayer holster 85. FIG. 9*b* shows two embodiments of the spray bottle assembly incorporating the present invention. Two trigger sprayers 80 are shown, one for use with the flexible tube 40, and one having a rigid dip tube 26.

The trigger sprayer holster 85 has a circular opening 87 which fits around the threaded opening 77 of the container 70. When the cap body 10 is threaded onto the container 70, the trigger holster 85 is held in place. The trigger sprayer holster 85 has a second opening 89 for accommodating the trigger sprayer 80, as shown in FIG. 9*c*. The trigger spray holster, in the illustrated embodiment is a cantilevered projection which has two L-shaped arms 86. The L-shaped arms 86 are mirrors of one another and cooperate to support the trigger sprayer 80.

Figure 10A:
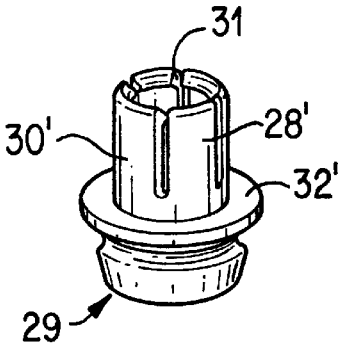
FIGS. 10*a* and 10*b* are a perspective view and a cross sectional view, respectively, of a second embodiment of the plastic connector for use with the cap 10 shown in FIGS. 8*a* and 8*b*.
Figure 10B:
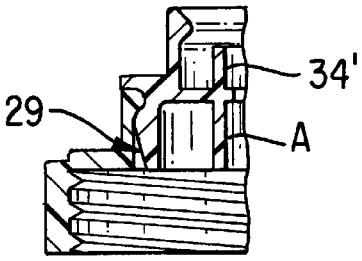
Figure 7:
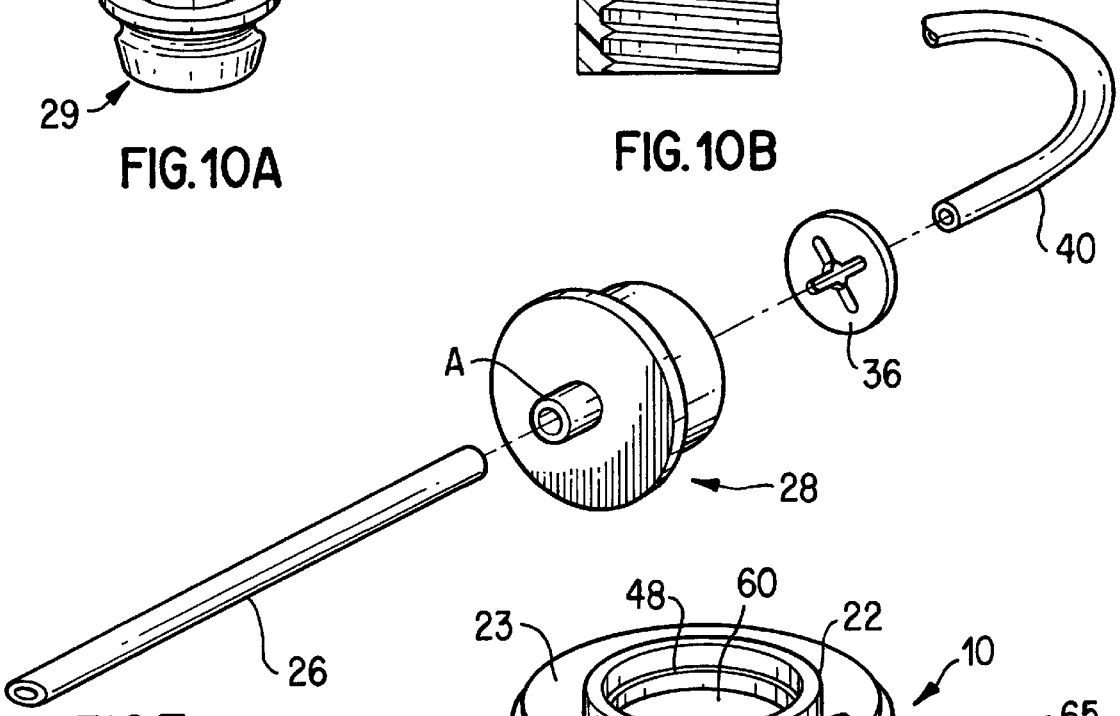
FIG. 7 is a perspective view of the plastic connector flexible tube, and rigid dip tube.

FIGS. 10*a* and 10*b* illustrate a second embodiment 28' of the plastic connector. The plastic connector 28' has a stop flange 32' which is wider than the base 32 shown in FIG. 5. Unlike the flange 32, the flange 32' does not fit within the cylindrical wall 22, but rather rests on top of the cylindrical wall 22. Below the stop flange 32', the connector 28' has a plug seal 29 that fits within the cylindrical wall to form a seal and retain the connector 28'. Above the stop flange 32' the connector 28' has a cylindrical body 30' which may have vertical slots 31 formed therein, projecting from the upper edge down toward the stop flange 32'. The cylindrical projection A is the same and projects downwards from the stop flange 32'. Further, a cylindrical inner wall 34' is provided projecting upward from the stop flange 32' to connect with the flexible tube 40.

Having described several embodiments of the rigid dip tube connector and container in accordance with the present invention, it is believed that other modifications, variations and changes will be suggested to those skilled in the art in view of the description set forth above. It is therefor to be understood that all such variations, modifications and changes are believed to fall within the scope of the invention as defined in the appended claims.

What is claimed is:

1. A connector for a rigid dip tube comprising:

a cap body having a lower body portion and a cap connected to said body portion by a hinge, said cap body having internal threads on an inside of a cylindrical side wall, said internal threads mating with threads on a liquid container;

said cap body comprising an annulus projecting inward from an upper edge of said cylindrical side wall, a first outer cylindrical wall disposed parallel to and inward of said outer cylindrical portion of said cap body, and a second inner cylindrical wall parallel to said first cylindrical wall, said first outer cylindrical wall and said second inner cylindrical wall projecting upward from said annulus;

said inner cylindrical wall being sized to accept a rigid dip tube in friction fit engagement, with said rigid dip tube extending into said liquid container; and a plastic connector comprising:

a circular base and a cylindrical body extending upwards perpendicularly from said base, said base having an outer diameter approximately equal to an inner diameter of said first outer cylindrical wall, a cylindrical projection extending downward from said circular base on a side opposite to said cylindrical body; and an inner cylindrical wall disposed inside said cylindrical body, said cylindrical wall being sized to accept a base of a flexible tube having an opposite end attached a sprayer, said cylindrical projection having an inner diameter equal to an outer diameter of said second inner cylindrical wall, wherein said plastic connector attaches to said body portion of said cap body so that said cylindrical projection fits around said second inner cylindrical wall and said base fits within said first outer cylindrical wall.

2. A connector as recited in claim 1, further comprising a disc is disposed on said flexible tube, near said base of said flexible tube and resting inside said cylindrical wall and on top of said conical portion to further locate and support said flexible tube.

3. A connector as recited in claim 1, wherein said conical portion guides said end of said flexible tube into said inner cylindrical wall.

4. A connector as recited in claim 1, wherein said cap further comprises a pair of inwardly projecting walls, a first wall fitting within said first outer cylindrical wall, and a second wall fitting around said second inner cylindrical wall, when said cap is closed on said body portion.

5. A connector as recited in claim 4, wherein said body portion has a circular step with a diameter approximately equal to an inner diameter of said cap.

6. A connector as recited in claim 4, wherein said first outer cylindrical wall have an inner cylindrical step to support and locate said base.

7. A connector as recited in claim 1, wherein when said cap body is open, said plastic connector fits into said first outer cylindrical wall, said plastic connector and said cap body combine to align said flexible tube and said rigid dip tube.

8. A connector for a rigid dip tube comprising:

a cap body having a lower body portion and a cap connected to said body portion by a hinge, said cap body having internal threads on an inside of a cylindrical side wall, said internal threads mating with threads on a liquid container;

said cap body comprising an annulus projecting inward from an upper edge of said cylindrical side wall, a first outer cylindrical wall disposed parallel to and inward of said outer cylindrical portion of said cap body, and a second inner cylindrical wall parallel to said first cylindrical wall, said first outer cylindrical wall and said second inner cylindrical wall projecting upward from said annulus;

said inner cylindrical wall being sized to accept a rigid dip tube in friction fit engagement, with said rigid dip tube extending into said liquid container; and a plastic connector comprising:

a circular base and a cylindrical body extending upwards perpendicularly from said base, said base having an outer diameter approximately equal to an inner diameter of said first outer cylindrical wall, a cylindrical projection sized to support said rigid dip tube so that said plastic connector aligns said flexible tube and said rigid dip tube, said cylindrical projection extending downward from said circular base on a side opposite to said cylindrical body; and an inner cylindrical wall disposed inside said cylindrical body, a conical portion extending from said cylindrical wall to said cylindrical body, said cylindrical wall being sized to accept a base of a flexible tube having an opposite end attached a sprayer, said cylindrical projection having an inner diameter approximately equal to an outer diameter of said second inner cylindrical wall, wherein said plastic connector attaches to said body portion of said cap body so that said base fits within said first outer cylindrical wall.

9. A connector as recited in claim 8, wherein said inner cylindrical wall and said cylindrical projection are integrally formed with said base.

10. A connector as recited in claim 8, wherein said cap body has an annulus projecting inward from an upper edge of said cylindrical side wall, and a first outer cylindrical wall disposed parallel to said first outer cylindrical wall projects upward from said annulus.

11. A connector as recited in claim 8, wherein an area inside of said first outer cylindrical wall forms a circular opening.

12. A connector as recited in claim 8, wherein said base of said plastic connector fits into an inner cylindrical step formed in said first outer cylindrical wall.

13. A connector as recited in claim 8, wherein said cap has an inwardly projecting wall, said inwardly projecting wall fitting within said first outer cylindrical wall, said plastic connector connecting and aligning said rigid dip tube and said flexible tube, said plastic connector snap fitting into said opening formed inside said first outer cylindrical wall of said cap body.

14. A connector as recited in claim 8, further comprising a trigger sprayer supporting arm having a circular opening which fits around a threaded opening of said liquid container, a second opening for accommodating said trigger sprayer.

* * * * *